US010079005B2

(12) United States Patent
Gao et al.

(10) Patent No.: US 10,079,005 B2
(45) Date of Patent: Sep. 18, 2018

(54) DISPLAY SUBSTRATE, DISPLAY DEVICE AND RESOLUTION ADJUSTMENT METHOD FOR DISPLAY SUBSTRATE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Bo Gao, Beijing (CN); Xiurong Wang, Beijing (CN); Hao Zhang, Beijing (CN); Lingyun Shi, Beijing (CN); Xue Dong, Beijing (CN); Yafei Li, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 147 days.

(21) Appl. No.: 15/107,851

(22) PCT Filed: Jan. 7, 2016

(86) PCT No.: PCT/CN2016/070384
§ 371 (c)(1),
(2) Date: Jun. 23, 2016

(87) PCT Pub. No.: WO2017/012300
PCT Pub. Date: Jan. 26, 2017

(65) Prior Publication Data

US 2017/0193972 A1 Jul. 6, 2017

(30) Foreign Application Priority Data

Jul. 21, 2015 (CN) ..... 2015 1 0431405

(51) Int. Cl.
*G09G 5/391* (2006.01)
*G09G 3/20* (2006.01)
*G09G 5/00* (2006.01)

(52) U.S. Cl.
CPC ..... *G09G 5/391* (2013.01); *G09G 3/20* (2013.01); *G09G 3/2074* (2013.01); *G09G 5/003* (2013.01);
(Continued)

(58) Field of Classification Search
CPC ..... G09G 5/227; G09G 2340/04–2340/0428
See application file for complete search history.

(56) References Cited

U.S. PATENT DOCUMENTS 7,427,973 B2 * 9/2008 Itakura ..... G09G 3/3648 345/100
7,439,965 B2 10/2008 Anderson
(Continued)

FOREIGN PATENT DOCUMENTS

CN 1424821 A 6/2003
CN 1848236 A 10/2006
(Continued)

OTHER PUBLICATIONS

Office Action in Chinese Application No. 201510431405.5 dated Apr. 10, 2017, with English translation. 10 pages.
(Continued)

*Primary Examiner* — Patrick F Marinelli
(74) *Attorney, Agent, or Firm* — Womble Bond Dickinson (US) LLP

(57) ABSTRACT

Embodiments of the invention relate to a display substrate comprising M data lines and N gate lines. The M data lines intersect with N gate lines to define a plurality of pixels. The display substrate comprises a resolution adjustment module which comprise: a resolution determination unit configured
(Continued)

to determine a target resolution; a signal input adjustment unit configured to determine a parameter a based on the target resolution and M and determine a parameter b based on the target resolution and N, and provide data signals to data lines spaced by every a data lines of the M data lines along an extending direction of the gate lines, and provide a same scanning signal to every b gate lines of the N gate lines along an extending direction of the data lines. Each of M and N is greater than 1, a≥0, b≥1.

17 Claims, 3 Drawing Sheets

(52) U.S. Cl.
CPC ..... *G09G 2300/0426* (2013.01); *G09G 2310/067* (2013.01); *G09G 2320/0613* (2013.01); *G09G 2330/021* (2013.01); *G09G 2340/0407* (2013.01); *G09G 2340/0457* (2013.01)

(56) References Cited

U.S. PATENT DOCUMENTS 8,847,946 B2 * 9/2014 Kang ..... G09G 3/20 345/213
2003/0112230 A1 6/2003 Maeda et al.
2004/0189681 A1 * 9/2004 Itakura ..... G09G 3/3648 345/698
2006/0232591 A1 * 10/2006 Lee ..... G09G 3/3674 345/502
2007/0146354 A1 * 6/2007 Kubota ..... G09G 3/2011 345/204
2008/0211794 A1 * 9/2008 Yi ..... G09G 3/3648 345/204
2009/0303225 A1 * 12/2009 Kang ..... G09G 3/20 345/213
2013/0016114 A1 * 1/2013 Rabii ..... G09G 5/363 345/589
2013/0127811 A1 * 5/2013 Fletcher ..... G06F 1/3218 345/211
2013/0271661 A1 * 10/2013 Kimura ..... H04N 5/44591 348/564
2014/0198021 A1 * 7/2014 Tu ..... G09G 3/3688 345/87
2015/0179149 A1 6/2015 Park
2016/0171938 A1 * 6/2016 Na ..... G09G 3/3688 345/698
2016/0329014 A1 * 11/2016 Lee ..... G09G 3/2096
2016/0358537 A1 * 12/2016 Kang ..... G06T 1/20
2016/0379538 A1 * 12/2016 Yan ..... G09G 5/006 345/698
2017/0011701 A1 * 1/2017 Yabuki ..... G09G 3/003
2017/0148420 A1 * 5/2017 Gao ..... G09G 5/391
2017/0193884 A1 * 7/2017 He ..... G09G 3/2092
2017/0193972 A1 * 7/2017 Gao ..... G09G 5/391
2017/0243531 A1 * 8/2017 Moon ..... G09G 3/2092

FOREIGN PATENT DOCUMENTS

CN 102254504 A 11/2011
CN 103778888 A 5/2014
CN 103869514 A 6/2014
CN 104952425 A 9/2015

OTHER PUBLICATIONS

International Search Report and Written Opinion of the ISA in PCT/CN2016/070384, with English translation. 16 pages.
Office Action in Chinese Application No. 201510431405.5 dated Aug. 16, 2016, with English translation. 10 pages.

* cited by examiner

DISPLAY SUBSTRATE, DISPLAY DEVICE AND RESOLUTION ADJUSTMENT METHOD FOR DISPLAY SUBSTRATE

RELATED APPLICATIONS

The present application is the U.S. national phase entry of PCT/CN2016/070384, with an international filing date of Jan. 7, 2016, which claims the benefit of Chinese Patent Application NO. 201510431405.5, filed on Jul. 21, 2015, the entire disclosure of which is incorporated herein by reference.

FIELD OF THE INVENTION

The invention relates to the field of display technology, particularly to a display substrate, a display device and a resolution adjustment method for the display substrate.

BACKGROUND

With the development of the display technology and the increase of user's requirement, the requirement on display designing and displaying becomes higher and higher. Along with the enhancement of the display effect of the display, some problems also arise accordingly, and the problem of high power consumption is exactly one of them. For terminal devices such as mobile phones and panel computers which rely on battery for work, the power consumption problem is more significant.

SUMMARY

The problem to be solved by embodiments of the invention is how to reduce the power consumption of the display device.

For this purpose, according to an aspect of the invention, a display substrate comprising M data lines and N gate lines is proposed, the M data lines intersecting with the N gate lines to define a plurality of pixels. The display substrate further comprises a resolution adjustment module, the resolution adjustment module comprises a resolution determination unit configured to determine a target resolution and a signal input adjustment unit configured to determine a parameter a based on the target resolution and M and determine a parameter b based on the target resolution and N, and provide data signals to data lines spaced by every a data lines of the M data lines along an extending direction of the gate lines, and provide a same scanning signal to every b gate lines of the N gate lines along an extending direction of the data lines. Each of M and N is greater than 1, a is greater than or equal to 0, b is greater than or equal to 1.

According to another embodiment of the invention, the target resolution is A*B, when every two data lines in the M data lines correspond to two columns of pixels, a=M/A−1, when every two gate lines in the N gate lines correspond to two rows of pixels, b=N/B, when every one data line in the M data lines corresponds to two columns of pixels, a=M/A−2, when every one gate line in the N gate lines corresponds to two rows of pixels, b=N/B−1. Each of A and B is greater than 1.

According to another embodiment of the invention, the signal input adjustment unit is further configured to provide a data signal to each of the M data lines, and provide scanning signals to every two adjacent gate lines of the N gate lines.

According to another embodiment of the invention, the signal input adjustment unit is further configured to provide a pixel borrowing signal to a data line adjacent to the data line provided with the data signal through sub-pixel rendering.

According to another embodiment of the invention, the display substrate further comprises an identification module configured to identify a type of a display content, and a prompt module configured to generate prompt information for reducing the resolution when the type of the display content is a static image.

According to another embodiment of the invention, the resolution adjustment module further comprises a simulation adjustment unit configured to adjust by simulation a resolution of the current display content based on a plurality of preset resolutions less than the resolution of the current display content when receiving the prompt information for reducing the resolution, and a comparison unit configured to compare a similarity between the adjusted display content by simulation and the current display content, to obtain a minimum resolution of the preset resolutions corresponding to the adjusted display content by simulation having a similarity greater than a preset value with the current display content.

According to another embodiment of the invention, the signal input adjustment unit adjusts the resolution of the current display content as the minimum resolution.

According to another embodiment of the invention, the display substrate further comprises a calculation module configured to calculate a first power consumption for the current display content and a second power consumption for a display content whose resolution is the minimum resolution, the prompt module is further configured to generate prompt information of the first power consumption and the second power consumption.

According to another aspect of the invention, a display device is proposed, which may comprise the display substrate described in any one of the above embodiments.

According to yet another aspect of the invention, a resolution adjustment method for a display substrate is proposed, the display substrate comprising M data lines and N gate lines, the M data lines intersecting with the N gate lines to define a plurality of pixels, the method comprises: determining a target resolution, determining a parameter a based on the target resolution and M and determining a parameter b based on the target resolution and N, providing data signals to data lines spaced by every a data lines of the M data lines along an extending direction of the gate lines, and providing a same scanning signal to every b gate lines of the N gate lines along an extending direction of the data lines. Each of M and N is greater than 1, a is greater than or equal to 0, b is greater than or equal to 1.

According to another embodiment of the invention, the target resolution is A*B, when every two data lines in the M data lines correspond to two columns of pixels, a=M/A−1, when every two gate lines in the N gate lines correspond to two rows of pixels, b=N/B, when every one data line in the M data lines corresponds to two columns of pixels, a=M/A−2, when every one gate line in the N gate lines corresponds to two rows of pixels, b=N/B−1. Each of A and B is greater than 1.

According to another embodiment of the invention, the method further comprises providing a data signal to each of the M data lines, and providing scanning signals to every two adjacent gate lines of the N gate lines.

According to another embodiment of the invention, the method further comprises providing a pixel borrowing signal to a data line adjacent to the data line provided with the data signal through sub-pixel rendering.

According to another embodiment of the invention, the method further comprises identifying a type of a display content, and generating prompt information for reducing the resolution when the type of the display content is a static image.

According to another embodiment of the invention, the method further comprises adjusting by simulation a resolution of the current display content based on a plurality of preset resolutions less than the resolution of the current display content when generating the prompt information for reducing the resolution and comparing a similarity between the adjusted display content by simulation and the current display content, to obtain a minimum resolution of the preset resolutions corresponding to the adjusted display content by simulation having a similarity greater than a preset value with the current display content.

According to another embodiment of the invention, the method further comprises adjusting the resolution of the current display content as the minimum resolution.

According to another embodiment of the invention, the method further comprises calculating a first power consumption for the current display content and a second power consumption for a display content whose resolution is the minimum resolution, and generating prompt information of the first power consumption and the second power consumption.

With the technical solutions of the above embodiments, the resolution can be reduced by adjusting the provision modes of the data signal and the scanning signal, so as to simplify the configuration mode and the provision mode of the data signal voltage and the scanning signal voltage, and power consumption may be reduced accordingly.

BRIEF DESCRIPTION OF THE DRAWINGS

The characteristics and advantages of embodiments of the invention will be understood more clearly by making reference to the drawings. The drawings are schematic and should not be understood as any limitations to the invention, in the drawings.

DETAILED DESCRIPTION OF THE INVENTION

In order to understand the above purposes, characteristics and advantages of the invention more clearly, the invention will be described in more detail with reference to the drawings and specific embodiments in the following. It should be noted that the embodiments and the features in the embodiments of the present application can be combined with one another in the case of not conflicting.

Many specific details are elaborated in the following for the convenience of understanding the invention sufficiently, however, the invention can also be implemented in other manners different from the manners described here. Hence, the protection scope of the application is not limited by the specific embodiments disclosed below.

Figure 2:
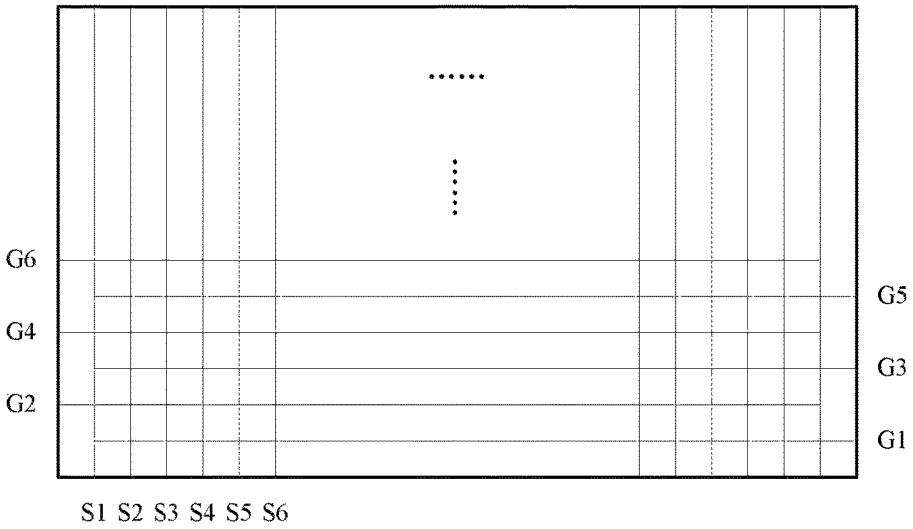
FIG. 2 shows a structural schematic view of a display substrate according to an embodiment of the invention.

As shown in FIG. 2, a display substrate 10 according to an embodiment of the invention comprises M data lines (e.g., S1, S2, S3, . . . , SM) and N gate lines (e.g., G1, G2, G3, . . . , GN), the M data lines intersecting with the N gate lines to define a plurality of pixels.

Figure 1:
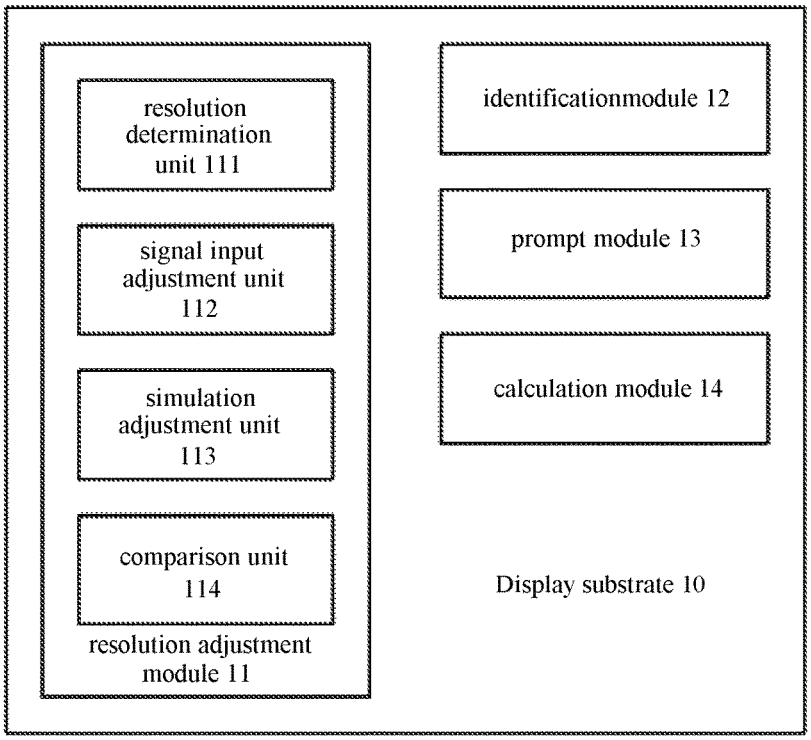
FIG. 1 shows a schematic block diagram of a display substrate according to an embodiment of the invention.

As shown in FIG. 1, the display substrate 10 further comprises a resolution adjustment module 11. The resolution adjustment module 11 comprises a resolution determination unit 111 configured to determine a target resolution (e.g., the target resolution may be determined based on a received instruction), and a signal input adjustment unit 112 configured to determine a parameter a based on the target resolution and M and determine a parameter b based on the target resolution and N, and provide data signals to data lines spaced by every a data lines of the M data lines along an extending direction of the gate lines, and provide a same scanning signal to every b gate lines of the N gate lines along an extending direction of the data lines. Each of M and N is greater than 1, a is greater than or equal to 0, b is greater than or equal to 1.

In another embodiment of the invention, the signal input adjustment unit 112 is further configured to provide a data signal to each of the M data lines, and provide different scanning signals to every two adjacent gate lines of the N gate lines.

Figure 3:
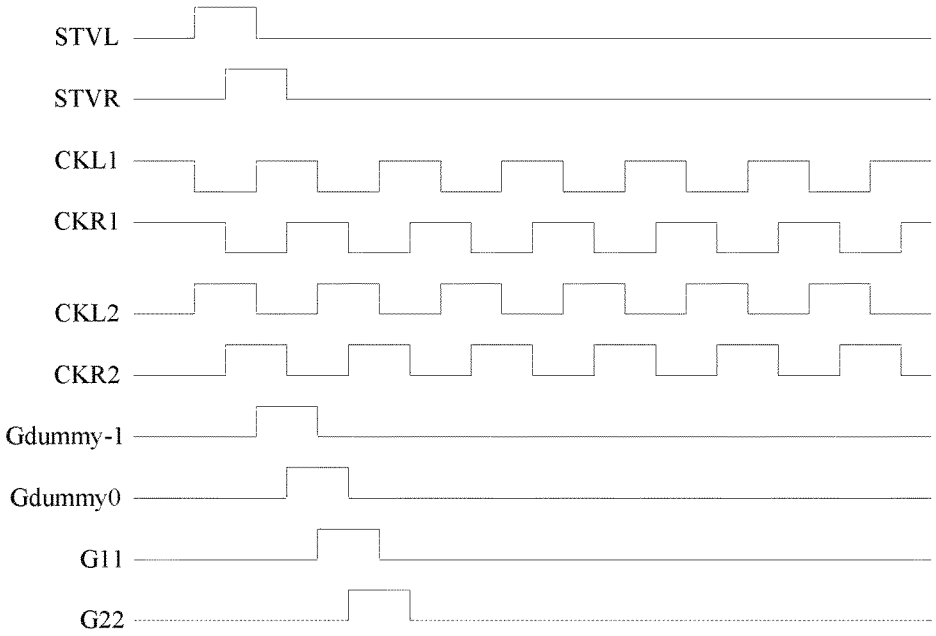
FIG. 3 shows a schematic view of a scanning signal according to an embodiment of the invention.

For example, as shown in FIG. 3, different scanning signals are provided to the gate lines G1 and G2, the scanning signal provided to the gate line G1 is one horizontal synchronizing signal (i.e., Hsync) advance than the scanning signal provided to the gate line G2. The scanning signal provided to the gate line G1 includes signals such as STVL, CKL1, CKL2, Gdummy−1, G11, and the scanning signal provided to the gate line G2 includes signals such as STVR, CKR1, CKR2, Gdummy0, G22. STVL and STVR are different, CKL1 and CKR1 are different, CKL2 and CKR2 are different, Gdummy−1 and Gdummy0 are different, G11 and G22 are different.

Although the signal provision mode according to this embodiment can ensure maximization of the resolution, however, in certain circumstances, for example, when reading text, it does not have to display the picture with the maximum resolution. Displaying with the maximum resolution may result in fast power consumption.

According to another embodiment of the invention, the target resolution is A*B, when every two data lines in the M data lines correspond to two columns of pixels, a=M/A−1. When every two gate lines in the N gate lines correspond to two rows of pixels, b=N/B. When every one data line in the M data lines corresponds to two columns of pixels, a=M/A−2. When every one gate line in the N gate lines corresponds to two rows of pixels, b=N/B−1. Each of A and B is greater than 1.

In the case of not having to display the picture with the maximum resolution, the resolution can be adjusted through the resolution adjustment module 11 in this embodiment. For example, in the event that every two data lines correspond to two columns of pixels and every two gate lines correspond to two rows of pixels, if M=2160, N=1440, the target resolution is A*B=1080*720, then data signals can be provide to data lines spaced by every 2160/1080−1=1 data lines in the 2160 data lines along the extending direction of the gate lines, and the same scanning signal can be provided to every 1440/720=2 gate lines in the 1440 gate lines along the extending direction of the data lines. When N cannot be divided evenly by B, for example, N/B=3/2, the switch for the gate lines can be adjusted by means of hardware. For example, one row of gate line is turned off in every three rows of gate lines.

For example, data signals may be provided to data lines of odd columns such as S1, S3, S5, a first scanning signal may be provided to gate lines G1 and G2, a second scanning signal may be provided to gate lines G3 and G4, . . . . It should be noted that in such a case, the data lines of even columns such as S2, S4, S6 still need to be inputted with high voltages so as to keep corresponding pixels thereof in a light state. For two adjacent gate lines to which different scanning signals are provided, the scanning signals may differ by one horizontal synchronizing signal.

The signal input adjustment unit 112 can comprise one or more integrated circuits. For example, the signal input adjustment unit 112 can comprise an integrated circuit for adjusting the scanning signal provision mode and an integrated circuit for adjusting the data signal provision mode. The signal input adjustment unit 112 may also only comprise an integrated circuit for adjusting the scanning signal provision mode, while the adjustment of the data signal provision mode may be carried out by a driving integrated circuit of the display substrate.

By adjusting the provision of the scanning signal and the data signal through the above modes, the horizontal resolution of the display substrate may be changed into ½ of the original, the longitudinal resolution may also be changed into ½ of the original, finally the resolution may be changed from 2160*1440 into 1080*720.

Figure 4:
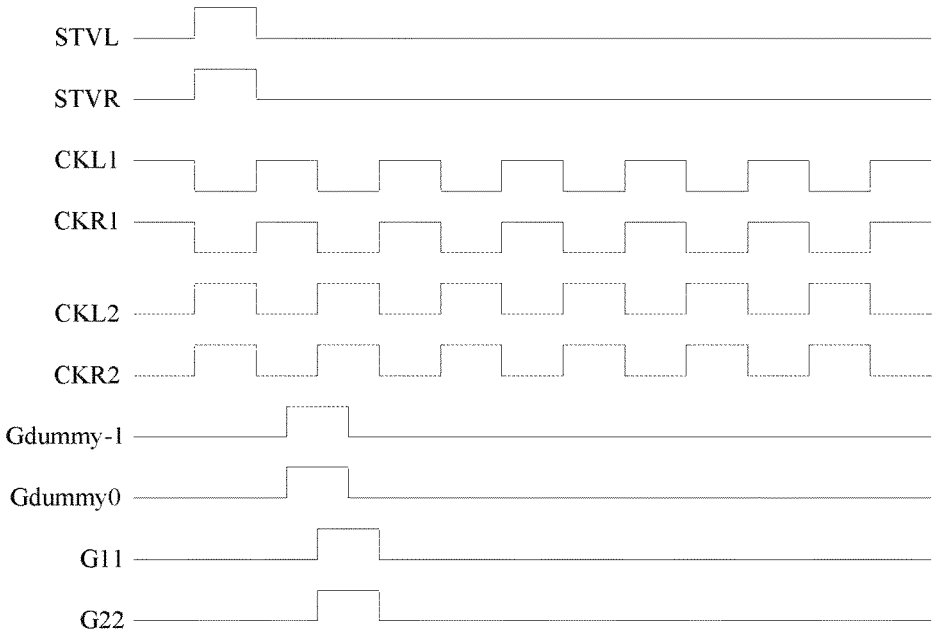
FIG. 4 shows a schematic view of a scanning signal according to a further embodiment of the invention.

For example, the first scanning signal provided to the gate lines G1 and G2 may be as shown in FIG. 4. The scanning signal provided to the gate line G1 may include signals such as STVL, CLK1, CKL2, Gdummy−1, G11, the scanning signal provided to the gate line G2 may include signals such as STVR, CKR1, CKR2, Gdummy0, G22. STVL and STVR are same, CKL1 and CKR1 are same, CKL2 and CKR2 are same, Gdummy−1 and Gdummy0 are same, G11 and G22 are same.

By comparison of FIG. 3 and FIG. 4, it can be seen that the signal provision mode in FIG. 4 is obviously simpler than the signal provision mode in FIG. 3. Hence, with the technical solution of this embodiment, the resolution can be adjusted by simplifying the signal provision mode, so as to reduce the configuration and adjustment process of the voltage corresponding to these signals, thereby reducing the power consumption.

In a pixel structure of transmitting data signals to two columns of pixels by one data line and transmitting scanning signals to two rows of pixels by one gate line, i.e., in the event that every one data line corresponds to two columns of pixels and every one gate line corresponds to two rows of pixels, if M=2160, N=1440, the target resolution is A*B=1080*720, then the data signals may be provided to data lines spaced by every 2160/1080−2=2−2=0 data lines in the 2160 data lines along the extending direction of the gate lines, i.e., providing data signals to each data line, and the same scanning signal may be provided to every 1440/720−1=2−1=1 gate lines in the 1440 gate lines along the extending direction of the data lines, i.e., providing the scanning signal to each gate line. In such a case, it may be further required to adjust the target for the data lines to transmit data signals and adjust the target for the gate lines to transmit scanning signals. For example, one data line transmits data signals to one of two columns of pixels to which it corresponds, and one gate line transmits scanning signals to one of two rows of pixels to which it corresponds.

According to another embodiment of the invention, the input terminals for the scanning signals of adjacent gate lines are located at different sides of the display substrate. Thus the wiring in the display substrate can be simplified.

According to another embodiment of the invention, the signal input adjustment unit 112 is further configured to provide a pixel borrowing signal to a data line adjacent to the data line provided with the data signal through sub-pixel rendering.

By driving the sub-pixels in adjacent columns of the pixels corresponding to the data lines for transmitting the data signals through the sub-pixel rendering, the visual resolution can be greater than the physical resolution, thereby improving the display effect while reducing the power consumption.

According to another embodiment of the invention, the display substrate 10 further comprises an identification module 12 configured to identify a type of a display content, and a prompt module 13 configured to generate prompt information for reducing the resolution when the type of the display content is a static image.

Thus, the user can be prompted automatically whether to reduce the resolution so as to reduce the power consumption when the type of the display content is identified as a static image. The prompt information may be transmitted to other modules or units in the display substrate 10. The prompt information may also be displayed in the form of text or image, or perform prompting in the form of sound or light.

According to another embodiment of the invention, the resolution adjustment module 11 further comprises a simulation adjustment unit 113 configured to adjust by simulation a resolution of the current display content based on a plurality of preset resolutions less than the resolution of the current display content when receiving the prompt information for reducing the resolution, and a comparison unit 114 configured to compare a similarity between the adjusted display content by simulation and the current display content, to obtain a minimum resolution of the preset resolutions corresponding to the adjusted display content by simulation having a similarity greater than a preset value with the current display content.

The signal input adjustment unit 112 may adjust the resolution of the current display content as the minimum resolution.

For example, the resolution of the current display content may be 2160*1440, a plurality of preset resolutions less than the resolution of the current display content may be 1440*720 and 720*360 respectively. After the resolution of the current display content is respectively adjusted by simulation to 1440*720 and 720*360, if the similarities between the adjusted display contents by simulation and the current display content are both greater than the preset value, the minimum resolution is obtained, i.e., 720*360. Then the signal input adjustment unit 112 may adjust the resolution of the current display content as 720*360. The adjustment by simulation would not perform actual adjustment to the resolution of the current display content, instead, a display content after the resolution of the current display content is adjusted to a corresponding resolution is obtained by calculation.

According to this embodiment, on the one hand, it can be ensured that the similarity between the display content after the resolution is adjusted and the current display content is relatively high, thereby it would not affect the viewing effect of the user. On the other hand, the minimum resolution can be automatically selected from the resolutions that meet the similarity for adjustment, and the smaller the resolution of the display content is, the lower the corresponding power consumption will be, thereby enabling the power consumption to be minimized while ensuring the viewing effect of the user.

According to another embodiment of the invention, the display substrate 10 further comprises a calculation module 14 configured to calculate a first power consumption of the current display content and a second power consumption of a display content whose resolution is the minimum resolution. The prompt module 13 is further configured to generate prompt information of the first power consumption and the second power consumption.

Thus, it facilitates the user to learn directly the profit of reduced power consumption to which the reduced resolution corresponds. For example, in the event that the display substrate is arranged in a mobile terminal, the prompt information may comprise the dump energy under the current resolution and the dump energy after being adjusted to the minimum resolution.

An embodiment of the invention further proposes a display device comprising a display substrate as described in any of the above embodiments.

The display device in this embodiment can be any product or component with the display function such as electronic paper, a mobile phone, a panel computer, a television, a laptop, a digital photo frame, a navigator etc. An embodiment of the invention further proposes a resolution adjustment method for a display substrate, the display substrate comprising M data lines and N gate lines, the M data lines intersecting with the N gate lines to define a plurality of pixels, the method may comprise determining a target resolution, determining a parameter a based on the target resolution and M and determine a parameter b based on the target resolution and N, and providing data signals to data lines spaced by every a data lines of the M data lines along an extending direction of the gate lines, and providing a same scanning signal to every b gate lines of the N gate lines along an extending direction of the data lines. Each of M and N is greater than 1, a is greater than or equal to 0, b is greater than or equal to 1.

According to another embodiment of the invention, the target resolution is A*B, when every two data lines in the M data lines correspond to two columns of pixels, a=M/A−1, when every two gate lines in the N gate lines correspond to two rows of pixels, b=N/B; when every one data line in the M data lines corresponds to two columns of pixels, a=M/A−2; when every one gate line in the N gate lines corresponds to two rows of pixels, b=N/B−1. Each of A and B is greater than 1.

According to another embodiment, the resolution adjustment method for a display substrate further comprises providing a data signal to each of the M data lines, and providing scanning signals to every two adjacent gate lines of the N gate lines.

According to another embodiment of the invention, the resolution adjustment method for a display substrate further comprises providing a pixel borrowing signal to a data line adjacent to the data line provided with the data signal through sub-pixel rendering.

Figure 5:
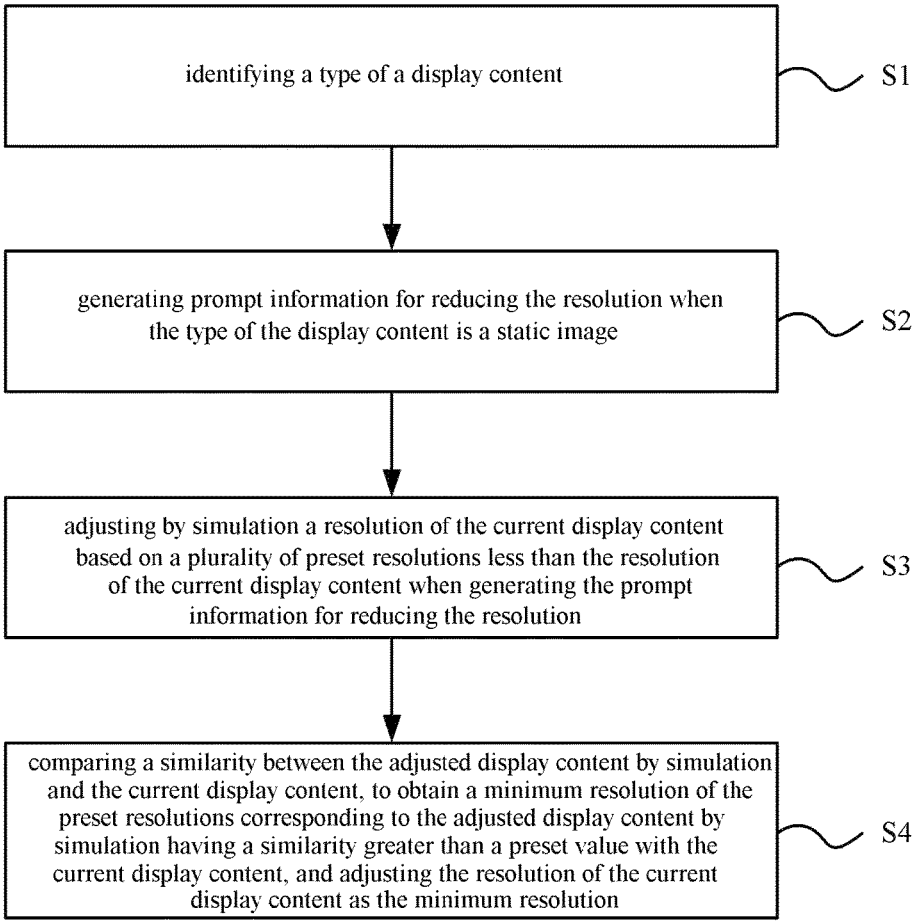
FIG. 5 shows a schematic flow chart of resolution adjustment according to an embodiment of the invention.

As shown in FIG. 5, according to another embodiment of the invention, the resolution adjustment method for a display substrate further comprises:

S1. identifying a type of a display content;

S2. generating prompt information for reducing the resolution when the type of the display content is a static image.

According to another embodiment of the invention, the resolution adjustment method for a display substrate further comprises:

S3. adjusting by simulation a resolution of the current display content based on a plurality of preset resolutions less than the resolution of the current display content when generating the prompt information for reducing the resolution;

S4. comparing a similarity between the adjusted display content by simulation and the current display content, to obtain a minimum resolution of the preset resolutions corresponding to the adjusted display content by simulation having a similarity greater than a preset value with the current display content, and adjusting the resolution of the current display content as the minimum resolution.

According to another embodiment of the invention, the resolution adjustment method for a display substrate further comprises calculating a first power consumption of the current display content and a second power consumption of a display content whose resolution is the minimum resolution; and generating prompt information of the first power consumption and the second power consumption.

Technical solutions of embodiments of the invention have been illustrated above in detail with reference to the drawings. With the technical solutions of the embodiments, the resolution can be reduced by adjusting the provision mode of the data signal and the scanning signal, so as to simplify the configuration mode and the provision mode of the data signal voltage and the scanning signal voltage, and power consumption may be reduced accordingly.

In this application, the terms such as "first", "second" are only used for describing purpose, and could not be understood as indicating or implying relative importance. The term "a plurality of" refer to two or more than two, unless otherwise specified.

What are stated above are only exemplary embodiments of the invention, which are not used for limiting the invention. For the skilled person in the art, various modifications and variations can be made to these embodiments. Any amendment, equivalent replacement and improvement made within the spirit and the principle of the invention should be encompassed within the protection scope of the invention.

The invention claimed is:

1. A display substrate, comprising M data lines and N gate lines, the M data lines intersecting with the N gate lines to define a plurality of pixels, wherein the display substrate further comprises a resolution adjustment module, the resolution adjustment module comprises:

a resolution determination unit configured to determine a target resolution;

a signal input adjustment unit configured to determine a parameter a based on the target resolution and M and determine a parameter b based on the target resolution and N, and provide data signals to data lines spaced by every a data lines of the M data lines along an extending direction of the gate lines, and provide a same scanning signal to every b gate lines of the N gate lines along an extending direction of the data lines, wherein each of M and N is greater than 1, a is greater than or equal to 0, b is greater than or equal to 1, wherein the target resolution is A*B, when every two data lines in the M data lines correspond to two columns of pixels, a=M/A−1;

when every two gate lines in the N gate lines correspond to two rows of pixels, b=N/B;

when every one data line in the M data lines correspond to two columns of pixels, a=M/A−2;

when every one gate line in the N gate lines correspond to two rows of pixels, b=N/B−1, wherein each of A and B is greater than 1.

2. The display substrate according to claim 1, wherein the signal input adjustment unit is further configured to provide a data signal to each of the M data lines, and provide scanning signals to every two adjacent gate lines of the N gate lines.

3. The display substrate according to claim 1, wherein the signal input adjustment unit is further configured to provide a pixel borrowing signal to a data line adjacent to the data line provided with the data signal through sub-pixel rendering.

4. The display substrate according to claim 1, wherein the display substrate further comprises:

an identification module configured to identify a type of a display content;

a prompt module configured to generate prompt information for reducing the resolution when the type of the display content is a static image.

5. The display substrate according to claim 4, wherein the resolution adjustment module further comprises:

a simulation adjustment unit configured to adjust by simulation a resolution of the current display content based on a plurality of preset resolutions less than the resolution of the current display content when receiving the prompt information for reducing the resolution;

a comparison unit configured to compare a similarity between the adjusted display content by simulation and the current display content, to obtain a minimum resolution of the preset resolutions corresponding to the adjusted display content by simulation having a similarity greater than a preset value with the current display content.

6. The display substrate according to claim 5, wherein the signal input adjustment unit adjusts the resolution of the current display content as the minimum resolution.

7. The display substrate according to claim 5, wherein the display substrate further comprises:

a calculation module configured to calculate a first power consumption for the current display content and a second power consumption for a display content whose resolution is the minimum resolution, wherein the prompt module is further configured to generate prompt information of the first power consumption and the second power consumption.

8. A resolution adjustment method for a display substrate, the display substrate comprising M data lines and N gate lines, the M data lines intersecting with the N gate lines to define a plurality of pixels, the method comprising:

determining a target resolution; and determining a parameter a based on the target resolution and M and determining a parameter b based on the target resolution and N, providing data signals to data lines spaced by every a data lines of the M data lines along an extending direction of the gate lines, and providing a same scanning signal to every b gate lines of the N gate lines along an extending direction of the data lines, wherein each of M and N is greater than 1, a is greater than or equal to 0, b is greater than or equal to 1, wherein the target resolution is A*B, when every two data lines in the M data lines correspond to two columns of pixels, a=M/A−1;

when every two gate lines in the N gate lines correspond to two rows of pixels, b=N/B;

when every one data line in the M data lines correspond to two columns of pixels, a=M/A−2;

when every one gate line in the N gate lines correspond to two rows of pixels, b=N/B−1, wherein each of A and B is greater than 1.

9. The resolution adjustment method for a display substrate according to claim 8, wherein the method further comprises:

providing a data signal to each of the M data lines, and providing scanning signals to every two adjacent gate lines of the N gate lines.

10. The resolution adjustment method for a display substrate according to claim 8, wherein the method further comprises:

providing a pixel borrowing signal to a data line adjacent to the data line provided with the data signal through sub-pixel rendering.

11. The resolution adjustment method for a display substrate according to claim 8, wherein the method further comprises:

identifying a type of a display content;

generating prompt information for reducing the resolution when the type of the display content is a static image.

12. The resolution adjustment method for a display substrate according to claim 11, wherein the method further comprises:

adjusting by simulation a resolution of the current display content based on a plurality of preset resolutions less than the resolution of the current display content when generating the prompt information for reducing the resolution;

comparing a similarity between the adjusted display content by simulation and the current display content, to obtain a minimum resolution of the preset resolutions corresponding to the adjusted display content by simulation having a similarity greater than a preset value with the current display content.

13. The resolution adjustment method for a display substrate according to claim 12, wherein the method further comprises:

adjusting the resolution of the current display content as the minimum resolution.

14. The resolution adjustment method for a display substrate according to claim 12, wherein the method further comprises:

calculating a first power consumption for the current display content and a second power consumption for a display content whose resolution is the minimum resolution, and generating prompt information of the first power consumption and the second power consumption.

15. A display device comprising a display substrate, the display substrate comprising M data lines and N gate lines, the M data lines intersecting with the N gate lines to define a plurality of pixels, wherein the display substrate further comprises a resolution adjustment module, the resolution adjustment module comprises:

a resolution determination unit configured to determine a target resolution;

a signal input adjustment unit configured to determine a parameter a based on the target resolution and M and determine a parameter b based on the target resolution and N, and provide data signals to data lines spaced by every a data lines of the M data lines along an extending direction of the gate lines, and provide a same scanning signal to every b gate lines of the N gate lines along an extending direction of the data lines, wherein each of M and N is greater than 1, a is greater than or equal to 0, b is greater than or equal to 1, wherein the target resolution is A*B, when every two data lines in the M data lines correspond to two columns of pixels, a=M/A−1;

when every two gate lines in the N gate lines correspond to two rows of pixels, b=N/B;

when every one data line in the M data lines correspond to two columns of pixels, a=M/A−2;

when every one gate line in the N gate lines correspond to two rows of pixels, b=N/B−1, wherein each of A and B is greater than 1.

16. The display device according to claim 15, wherein the display substrate further comprises:

an identification module configured to identify a type of a display content;

a prompt module configured to generate prompt information for reducing the resolution when the type of the display content is a static image.

17. The display device according to claim 16, wherein the resolution adjustment module further comprises:

a simulation adjustment unit configured to adjust by simulation a resolution of the current display content based on a plurality of preset resolutions less than the resolution of the current display content when receiving the prompt information for reducing the resolution;

a comparison unit configured to compare a similarity between the adjusted display content by simulation and the current display content, to obtain a minimum resolution of the preset resolutions corresponding to the adjusted display content by simulation having a similarity greater than a preset value with the current display content.

* * * * *